United States Patent [19]

Davies et al.

[11] Patent Number: 4,988,615

[45] Date of Patent: Jan. 29, 1991

[54] STABILIZERS FOR PHOTOGRAPHIC EMULSIONS

[75] Inventors: Paul Davies, White Bear lake; Nelson B. O'Bryan, Jr., St. Paul; James B. Philip, Jr., Mahtomedi, all of Minn.

[73] Assignee: Minnesota Mining and Mnaufacturing Company, St. Paul, Minn.

[21] Appl. No.: 154,293

[22] Filed: Feb. 10, 1988

[51] Int. Cl.[5] ..... G03C 1/02

[52] U.S. Cl. ..... 430/576; 430/572; 430/607; 430/610; 430/612

[58] Field of Search ..... 430/576, 572, 610, 607, 430/612

[56] References Cited

U.S. PATENT DOCUMENTS

| | | | |
|---|---|---|---|
| 3,951,661 | 4/1976 | Soma et al. | 430/533 |
| 4,013,469 | 3/1977 | Haga et al. | 430/610 |
| 4,536,473 | 8/1985 | Mihara | 430/575 |
| 4,578,347 | 3/1986 | Philip, Jr. | 430/572 |
| 4,596,767 | 6/1986 | Mihara et al. | 430/576 |
| 4,677,053 | 6/1987 | Mihara et al. | 430/576 |

*Primary Examiner*—Paul R. Michl
*Assistant Examiner*—Thorl Chea
*Attorney, Agent, or Firm*—Donald M. Sell; Walter N. Kirn; Mark A. Litman

[57] ABSTRACT

The addition of certain classes of organic salts to infrared sensitive silver halide photographic emulsions can provide supersensitization, improved liquid hold time stability, and photographic emulsion stability.

37 Claims, No Drawings

STABILIZERS FOR PHOTOGRAPHIC EMULSIONS

FIELD OF INVENTION

This invention relates to photographic elements, particularly to infrared sensitive elements, and more particularly to compounds useful in (1) supersensitizing, (2) improving liquid hold time stability, and (3) improving the keeping properties of the coated infrared sensitive material.

BACKGROUND OF THE INVENTION

In most uses of silver halide in photographic materials, it is desirable to increase the speed or sensitivity of the emulsion. There are a number of different techniques for increasing the speed of an emulsion which are usually classified as chemical sensitization or spectral sensitization. Chemical sensitization usually involves modification of the silver halide grains to make the most efficient use of the radiation that they absorb. The three general types of chemical sensitization are sulfur sensitization, reduction sensitization, and precious (noble) metal sensitization. These methods of chemical sensitization are well known and firmly established in the art (e.g., James, T. H. and Vanselow, W. "Chemical Sensitization", J Photo. Sci., 1, 133 (1953), Freiser, H. and Ranz, E., Ber. der Bunsengesellschaft, 68, 389 (1964), and Pouradier, J. "Chemical Sensitization", Photographic Theory: Liege Summer School, A. Hautot, p. 111, Focal Press (London 1963).

Spectral sensitization enables grains to benefit from radiation in regions of the electromagnetic spectrum where the silver halide would ordinarily not absorb. Dyes which absorb radiation and can transfer energy to the grains to help in the photoreduction of silver ions to clusters of silver metal are conventionally used to effect spectral sensitization.

Another phenomenon associated with the use of spectral sensitizing dyes is known in the art as supersensitization. The addition of other substances, frequently in quantities ranging from less than an equivalent molar rate to a 100 fold molar excess of supersensitizer to dye, can increase the spectrally sensitized speed of the emulsion by more than an order of magnitude. Some supersensitizers are dyes themselves, but many others do not absorb radiation in significant amounts in the visible portion of the electromagnetic spectrum. Therefore, the effect of supersensitizers on spectral sensitization is not clearly dependent on the ability of compounds to absorb radiation in the visible portion of the spectrum. Certain cyanines, merocyanines compounds analogous to cyanines, certain acylmethylene derivatives of heterocyclic bases, and ketone derivatives such as p-dimethylaminobenzalacetone are known supersensitizers. An expanded selection of supersensitizers is therefore desired.

Silver halide emulsions can be protected against the production of fog and stabilized against the loss of sensitivity during keeping. Suitable antifoggants and stabilizers which can be used alone or in combination, include triphenylphoshines, amines, arsines, bismuthines, and stibildynes taught in U.S. Pat. No. 4,578,347; the thiazolium salts described in Staud, U.S. Pat. No. 2,131,038 and Allen, U.S. Pat. No. 3,694,716; the azaindenes described in Piper, U.S. Pat. No. 2,886,437 and Heimbach, U.S. Pat. No. 2,444,605; the mercaptotetrazoles described in Kendall et al., U.S. Pat. No. 2,403,927, Kennard et al., U.S. Pat. No. 3,266,897 and Luckey et al., U.S. Pat. No. 3,397,987; and the oximes described in Carroll et al., British Pat. No. 623,448. With respect to infrared sensitive emulsions, G.B. Pat. No. 2,140,928 describes the use of heterocyclic indolinium dyes to maintain stability.

However, it is well known in the prior art that infrared sensitive photographic materials exhibit poor keeping properties (Neblette's Handbook of Photography and Reprography, 7th. Edition, Ed. Sturge, Pub. Van Nostrand). Even with the above mentioned additives, it has not been possible to maintain adequate stability of an infrared sensitive emulsion. As a consequence, many infrared sensitive photographic materials stipulate refrigeration, and put limitations on storage humidity in order to extend the shelf-life as much as possible.

By incorporating quaternary aryl- or alkyl- Group V compounds, in particular the tetraphenylphosphonium salts, into an infrared sensitive emulsion, we have found that photographic speed may be increased, the liquid emulsion may be held for extended times prior to coating, and the keeping properties of the material improved.

SUMMARY OF THE INVENTION

The addition to infrared sensitized silver halide photographic emulsions of compounds of the formula:

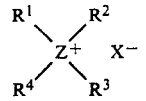

(I)

where $R^1$–$R^4$ may be H, an alkyl, aryl or aralkyl group, or any combination thereof, and $R^1$, $R^2$, $R^3$ and $R^4$ may be combined with Z to form a ring system (e.g., morpholino); Z may be an element from Group V of the Periodic Table; and $X^-$ may be an acid anion such as a chloride, bromide, or iodide anion, to photographic silver halide emulsions, will increase sensitivity, reduce the loss in sensitivity when the emulsion is held for extended periods in a liquid state (prior to coating), and will improve the shelf life of the coated material.

Compounds of formula (I) may also be incorporated into a layer adjacent to the emulsion in order to improve shelf life of the coated material.

Preferably, compounds of formula (I) are added to chlorobromide or iodobromide emulsions sensitized to the infrared region of the electromagnetic spectrum.

The most preferred compound of formula (I) is tetraphenylphosphonium chloride.

BACKGROUND OF THE ART

The present invention describes the use of quaternary alkyl- or aryl- Group V compounds as supersensitizers and stabilizers in IR sensitive emulsions. The levels used are in the range 50–400 mg per mole of silver, equivalent to 0.1–0.8 millimoles per mole of silver, which is equal to 0.15–1.0 mg/sq.ft. in coated material.

Most of the patents on quaternary ammonium and phosphonium compounds claim their use as antifoggants and supersensitizers. Often they are the substituent groups of a heterocyclic nitrogen compound. In a few recent cases, tetraalkyl ammonium and inorganic ammonium bromides have been claimed as stabilizers for infrared materials. Other disclosures of quaternary ammonium and phosphonium compounds relate to their action as supersensitizers, development accelerators and fixer components in "stabilization" type processing. In many cases the patents discussing quaternary ammonium compounds relate to dry silver systems and/or non-aqueous solutions of these compounds.

U.S. Pat. No. 2,238,632. Dersch et al., describes the use of organic arsenic, antimony and phosphonium iodides as "yellow" (dichroic) fog inhibitors.

U.S. Pat. No. 2,288,586. Dersch et al., also describes dichroic fog inhibitors, using organic ammonium iodides.

U.S. Pat. No. 3,093,479. Olivares et al., discloses the use of quaternary ammonium compounds for the prevention of sulfiding, staining and image fading of processed materials.

U.S. Pat. No. 3,212,899 Kennard et al., describes the sensitization of silver halide using a combination of a quaternary ammonium salt and a developing agent.

U.S. Pat. No. 3,243,295, Vogt, describes the processing of multicolor sound-track recordings through a bath containing a quaternary ammonium compound.

U.S. Pat. No. 3,582,345. McBride, describes quaternary (hydroxyalkyl) phosphonium salts which can increase speed and image density in light-developable direct print systems.

U.S. Pat. No. 3,598,590. Huckstadt et al., details the use of heterocyclic quaternary ammonium compounds as chemical sensitizers in color films.

U.S Pat. No. 3,615,510. Yudelson, describes the use of quaternary ammonium and phosphonium compounds for post processed image stability in dry silver "stabilization" type processing.

U.S. Pat. No. 3,734,739. Borrer, describes a novel class of cyanine dye sensitizers containing a quaternary ammonium or phosphonium group.

U.S. Pat. No. 3,951,661. Soma et al., describes the use of quaternary phosphonium compounds as antifoggants, said antifoggant containing an electron-attracting group on at least one of the organic groups.

U.S. Pat. No. 4,458,010. Yamamuro et al., describes a bleaching process for color photographic materials using compounds containing quaternary ammonium or phosphonium groups.

U.S. Pat. No. 4,471,044. Parton et al., discloses the use of alkynyl substituted heterocyclic quaternary ammonium salts for increased speed in negative working emulsions, and improved incubation stability in direct positive systems.

U.S. Pat. No. 4,536,473. Mihara, describes the use of water soluble bromides for increased speed and improved shelf life of infrared photographic materials. The claims of water soluble bromides included ammonium and tetraethyl ammonium bromides, but were not shown by examples. These salts are in the same class of compounds as the present invention. The infrared sensitizing dyes specified in Mihara include a dicarbocyanine dye having a 4-quinoline nucleus and/or tricarbocyanine dyes.

U.S. Pat. No. 4,578,347. Philip, describes the effect of water soluble Group V triaryl compounds, e.g., phosphines and amines, as supersensitizers.

U.S. Pat. No. 4,596,767. Mihara et al., describes improved hold time stability and shelf life of infrared sensitive emulsions with the use of a combination of an IR sensitizing dye and a nitrogen containing heterocyclic compound.

U.S. Pat. No. 4,607,004. Ikenoue et al., describes water soluble phenylmercaptotetrazoles, wherein the water solubilizing group can be a quaternary ammonium group, that provides improved shelf life of color photographic materials.

U.S. Pat. No. T105,001. Parton et al., describes the use of thioamido and alkynyl substituted heterocyclic ammonium salts as supersensitizers in negative acting emulsions, and improved incubation stability in direct positive systems.

G.B. No. 566,314. Howe et al., describes the addition of tetra alkyl ammonium or phosphonium surfactants, where at least one of the alkyls is a 17 carbon chain lipophylic group of at least 8 carbon atoms, to a developer will enhance speed.

G.B. No. 1,351,463. Adcock et al. describe water soluble quaternary ammonium and phosphonium derivatives of azodicarbonamides as antifoggants.

U.K. Application No. 2,140,928 A. Mihara et al., discloses that a combination of dye and heterocyclic nitrogen compound improves hold time stability, aging and increases speed in infrared sensitive emulsions.

U.K. Application No. 2,176,304. Ohashi et al., describes the use of nitrogen containing heterocyclic compounds with a quaternary ammonium or phosphonium group as a stabilizer.

J.P. Application No. 57-74738, Tadaoki et al., describes the antifoggant and supersensitization effects of a combination of a quaternary ammonium or phosphonium compound and a thioether compound, as an antifoggant and supersensitizer.

Akhmedzyanov et al., Zhurnel Nauchnio i Prikadnoi Fotografi i Kinematograffi 14 (2), 148–149 (1969) and 12 (6), 462–463 (1967), and Demchuk et al., Zhurnel Prikadnoi Specktrosk., 33 (3), 557 (1980), describe the use of triphenylphosphine as a supersensitizer and stabilizer for infrared sensitive silver halide.

DETAILED DESCRIPTION OF THE INVENTION

Compounds represented by the formula:

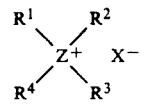

(I)

wherein $R^1$–$R^4$ are $H^+$, alkyl aryl or aralkyl groups, or any combination thereof, and $R^1$, $R^2$, $R^3$ and $R^4$ may be combined to form a ring system: Z is an element from Group V of the Periodic Table; and $X^-$ is an acidic anion group, are useful as supersensitizers, for extending the liquid hold time of the photographic emulsion and improving the shelf life of the coated infrared material.

$R^1$–$R^4$ may be hydrogen, aliphatic groups from methyl up to and including octyl, phenyl or benzyl, wherein the aryl group may be substituted or unsubstituted; Z may be N, P; $X^-$ may be $Br^-$, $Cl^-$, $I^-$, $HSO_4^-$, $BF_4^-$, $SbF_6^-$ or p-toluenesulfonic acid.

The selection of groups $R^1$–$R^4$ is important in the practice of the present invention. The total number of carbon atoms in these groups should be at least 18 with at least two of the groups pentyl or larger. Preferably all groups are pentyl or larger with total carbon atoms of at least 20, generally in a range of 20–56, more preferably at least hexyl in a range of 24–36 carbon atoms, and most preferably 24–32 carbon atoms as the alkyl groups. When any of $R^1$–$R^4$ is aralkyl or aryl (e.g., phenyl or substituted phenyl) or alkaryl, those R groups should have between 6 and 20 carbon atoms (e.g., phenyl, phenylmethyl, methylphenyl, naphthyl, etc.)

Of these many analogues, those having functional groups that impart water solubility are preferred, of which tetraphenylphosphonium chloride is the most preferred compound for this application.

Examples of compounds of the present invention include, but are not limited to, the following:

Benzyldimethylphenylammonium chloride
Benzyltriethylammonium chloride
Benzyltriphenylphosphonium chloride
Dimethylbenzyltrimethylammonium iodide
Tetrabutylammonium hydrogen sulfate
Tetrabutylammonium tetrafluoroborate
Tetrabutylammonium bromide
Tetrahexylammonium bromide
Tetrabutylammonium iodide
Tetrahexylammonium iodide
Tetraheptylammonium iodide
Tetraheptylammonium bromide
Tetraoctylammonium bromide
Tetraphenylphosphonium bromide
Tetraoctylammonium iodide
Tetrapentylammonium chloride
Tetrapentylammonium bromide
Tetrapentylammonium iodide
Tetraphenylphosphonium chloride
Tetraphenylphosphonium hexafluoroantimonate
Triethyl(m-hydroxyphenyl)ammonium iodide
Triphenylmethylphosphonium iodide
Triphenylmethyltriphenylphosphonium bromide
Triphenylphosphonium bromide
Triethylphenylammonium iodide
Trimethylphenylammonium chloride
Trimethylphenylammonium iodide These types of compounds may be added to silver halide emulsions, or the emulsion top coat, prior to coating in the amount of at least 0.01 millimoles per mole of silver, preferably at least 0.05 millimeter and more preferably in the range 0.1–0.8 millimoles per mole of silver. The most preferred quantity of the compounds in the present invention is about 0.4 millimole per mole of silver. The preferred compound of this present invention is tetraphenylphosphonium chloride. The preferred compound of this invention may be added to the emulsion 24 hours prior to coating. The preferred emulsion in the present invention is a rhuthenium-iridium doped, high contrast chlorobromide emulsion, spectrally sensitized to the near infrared region of the electromagnetic spectrum.

The benefits of the present invention are particularly useful in black-and-white photographic film such a radiographic film, infrared sensitive film, graphic arts film, laser scanner film, and the like. The invention can also be practiced with color generating film and paper.

Any of the various types of photographic silver halide emulsions may be used in the practice of the present invention. Silver chloride, silver bromide, silver iodobromide, silver chlorobromide, silver chlorobromoiodide and mixtures thereof may be used for example. Any configuration of grains, cubic orthorhombic, hexagonal, epitaxial, lamellar, tabular or mixtures thereof may be used. These emulsions are prepared by any of the well-known procedures, e.g., single or double jet emulsions as described by Nietz et al., U.S. Pat. No. 2,222,264, Illingsworth, U.S. Pat. No. 3,320,069, McBride, U.S. Pat. No. 3,271,157 and U.S. Pat. Nos. 4,425,425 and 4,425,426.

The silver halide emulsions of this invention can be unwashed or washed to remove soluble salts. In the latter case the soluble salts can be removed by chill-setting and leaching or the emulsion can be coagulation washed e.g., by the procedures described in Hewitson et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341.

Photographic emulsions in accordance with this invention can be sensitized with chemical sensitizers, such as with reducing agents; sulfur, selenium or tellurium compounds; gold, platinum or palladium compounds; or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The silver halide emulsions of this invention can contain speed increasing compounds such as polyalkylene glycols, cationic surface active agents and thioethers or combinations of these as described in Piper, U.S. Pat. No. 2,886,437; Chechak, U.S. Pat. No. 3,046,134; Carroll et al., U.S. Pat. No. 2,944,900; and Goffe, U.S. Pat. No. 3,294,540.

Silver halide emulsions of this invention can be protected against the production of fog and can be stabilized against loss of sensitivity during keeping. Suitable antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; nitron; nitroindazoles; the polyvalent metal salts described in Jones, U.S. Pat. No. 2,839,405; the thiuronium salts described in Herz, U.S. Pat. No. 3,220,839; and the palladium, platinum and gold salts described in Trivelli, U.S. Pat. No. 2,566,263 and Damschroder, U.S. Pat. No. 2,597,915.

Silver halide grains in accordance with the invention can be dispersed in colloids that can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfones, active halogen compounds, epoxy compounds, aziridines, active olefins, isocyanates, carbodiimides, mixed function hardeners and polymeric hardeners such as oxidized polysaccharides, e.g., dialdehyde starch, oxyguargum, etc.

Photographic emulsions according to the present invention can contain various colloids alone or in combination as vehicles or binding agents. Suitable hydrophilic materials include both naturally-occurring substances such as proteins, for example, gelatin, gelatin derivatives (e.g., phthalated gelatin), cellulose derivatives, polysaccharides such as dextran, gum arabic and the like; and synthetic polymeric substances such as water soluble polyvinyl compounds, e.g., poly(vinylpyrrolidone) acrylamide polymers or other synthetic polymeric compounds such as dispersed vinyl compounds in latex form, and particularly those which increase the dimensional stability of the photographic materials. Suitable synthetic polymers include those described, for example, in U.S. Pat. Nos. 3,142,568 of Nottorf; 3,193,386 of White; 3,062,674 of Houck, Smith and Yudelson; 3,220,844 of Houck, Smith and Yudelson; Ream and Fowler, 3,287,289; and Dykstra, U.S. Pat. No. 3,411,911; particularly effective are those water-insoluble polymers of alkyl acrylates and methacrylates, acrylic acid, sulfoalkyl acrylates or methacrylates, those which have cross linking sites which facilitate hardening or curing and those having recurring sulfobetaine units as described in Canadian Patent No. 774,054.

Emulsions in accordance with this invention can be used in photographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056 and 3,206,312 or insoluble inorganic salts such as those described in Trevoy, U.S. Pat. No. 3,428,451.

Photographic emulsions of the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

Emulsions of the invention can contain plasticizers and lubricants such as polyalcohols, e.g., glycerin and diols of the type described in Milton, U.S. Pat. No. 2,960,404; fatty acids or esters such as those described in Robijns, U.S. Pat. No. 2,588,765 and Duane, U.S. Pat. No. 3,121,060; and silicone resins such as those described in DuPont British Patent No. 955,061.

The photographic emulsions as described herein can contain surfactants such as saponin, anionic compounds such as the alkylarylsulfonates described in Baldsiefen, U.S. Pat. No. 2,600,831 fluorinated surfactants, and amphoteric compounds such as those described in Ben-Ezra, U.S. Pat. No. 3,133,816.

Photographic elements containing emulsion layers as described herein can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Emulsions of the invention can be utilized in photographic elements which contain brightening agents including stilbene, triazine, oxazole and coumarin brightening agents. Water soluble brightening agents can be used such as those described in Albers et al., German Patent No. 972,067 and McFall et al., U.S. Pat. No. 2,933,390 or dispersions of brighteners can be used such as those described in Jansen, German Patent No. 1,150,274 and Oetiker et al., U.S. Pat. No. 3,406,070.

Photographic elements containing emulsion layers according to the present invention can be used in photographic elements which contain light absorbing materials and filter dyes such as those described in Sawdey, U.S. Pat. No. 3,253,921; Gaspar, U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Contrast enhancing additives such as hydrazines, rhodium, iridium and combinations thereof are also useful.

Photographic emulsions of this invention can be coated by various coating procedures including dip coating, air knife coating, curtain coating, or extrusion coating using hoppers of the type described in Beguin, U.S. Pat. No. 2,681,294. If desired, two or more layers may be coated simultaneously by the procedures described in Russell, U.S. Pat. No. 2,761,791 and Wynn, British Patent No. 837,095.

The couplers may be present either directly bound by a hydrophilic colloid or carried in a high temperature boiling organic solvent which is then dispersed within a hydrophilic colloid. The colloid may be partially hardened or fully hardened by any of the variously known photographic hardeners. Such hardeners are free aldehydes (U.S. Pat. No. 3,232,764), aldehyde releasing compounds (U.S. Pat. Nos. 2,870,013 and 3,819,608), s-triazines and diazines (U.S. Pat. Nos. 3,325,287 and 3,992,366), aziridines (U.S. Pat. No. 3,271,175), vinylsulfones (U.S. Pat. No. 3,490,911), carbodiimides, and the like may be used.

The silver halide photographic elements can be used to form dye images therein through the selective formation of dyes. The photographic elements described above for forming silver images can be used to form dye images by employing developers containing dye image formers, such as color couplers, as illustrated by U.K. Patent No. 478,984; Yager et al., U.S. Pat. No. 3,113,864; Vittum et al., U.S. Pat. Nos. 3,002,836, 2,271,238 and 2,362,598. Schwan et al. U.S. Pat. No. 2,950,970; Carroll et al., U.S. Pat. No. 2,592,243; Porter et al., U.S. Pat. Nos. 2,343,703, 2,376,380 and 2,369,489; Spath U.K. Patent No. 886,723 and U.S. Pat. No. 2,899,306; Tuite U.S. Pat. No. 3,152,896 and Mannes et al., U.S. Pat. Nos. 2,115,394, 2,252,718 and 2,108,602, and Pilato U.S. Pat. No. 3,547,650. In this form the developer contains a color-developing agent (e.g., a primary aromatic amine which in its oxidized form is capable of reacting with the coupler (coupling) to form the image dye. Also, instant self-developing diffusion transfer film can be used as well as photothermographic color film or paper using silver halide in catalytic proximity to reducable silver sources and leuco dyes.

The dye-forming couplers can be incorporated in the photographic elements, as illustrated by Schneider et al. Die Chemie, Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S. Pat. No. 3,409,435 and Chen Research Disclosure, Vol. 159, July 1977, Item 15930. The dye-forming couplers can be incorporated in different amounts to achieve differing photographic effects. For example, U.K. Patent No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are non-diffusible, colorless couplers, such as two and four equivalent couplers of the open chain ketomethylene, pyrazolone, pyrazolone, pyrazolotriazole, pyrazolobenzimidazole, phenol and naphthol type hydrophobically ballasted for incorporation in high-boiling organic (coupler) solvents.

Other conventional photographic addenda such as coating aids, antistatic agents, acutance dyes, antihalation dyes and layers, antifoggants, latent image stabilizers, antikinking agents, and the like may also be present.

Although not essential in the practice of the present invention, one particularly important class of additives which finds particular advantage in the practice of the present invention is high intensity reciprocity failure (HIRF) reducers. Amongst the many types of stabilizers for this purpose are chloropalladites and chloroplatinates (U.S. Pat. No. 2,566,263), iridium and/or rhodium salts (U.S. Pat. No. 2,566,263; 3,901,713), cyanorhodates (Beck et al., J. Signalaufzeichnungsmaterialen, 1976, 4, 131), and cyanoiridates.

These and other aspects of the invention will be shown by the Examples.

EXAMPLE 1

A ruthenium-iridium doped 66:34 chlorobromide emulsion, having an average grain size of 0.30 micron diameter, was chemically sensitized with p-toluenethiosulfonate, sodium thiosulfate and sodium gold tetrachloride at a pH of 5.0. It was then dye sensitized to the infrared region using 5,6-dimethyl-3-ethyl-2-(7-(5,6-dimethyl-3-ethyl-2(3H)-benzoxazolidene)-4-chloro-3,5-dimethylene-1,3,5-heptatrienyl)benzoxazolium iodide. 180 mg of phenyl-5-mercaptotetrazole (PMT) per mole of silver was also added. 150 mg of tetraphenylphosphonium chloride (TPP-Cl), or 150 mg tetraphenylphosphonium bromide (TPP-Br) per mole of silver was added, in the form of aqueous solutions, to equal portions of the emulsion just prior to coating. A control without either of the phosphonium salts was also coated. The coated samples were preconditioned for 4 hours at 60% RH, sealed in moisture proof bags and incubated for 3 days at 50° C., with controls stored at ambient temperature. Samples were exposed for $10^{-3}$ seconds through a narrow bandpass filter at 810 nm and processed in rapid access type chemistry.

The changes in Dmin and speed (at D=0.20) are given in Table 1.

TABLE 1

| | 3 Days Ambient Storage | | 3 Days @ 50° C. | |
|---|---|---|---|---|
| SAMPLE | Dmin | Speed (logE) | Dmin | Speed (LogE) |
| Control | 0.042 | 1.00 | 0.052 | 0.91 |
| TPP-Br | 0.041 | 0.99 | 0.049 | 1.00 |

TABLE 1-continued

| | 3 Days Ambient Storage | | 3 Days @ 50° C. | |
|---|---|---|---|---|
| SAMPLE | Dmin | Speed (logE) | Dmin | Speed (LogE) |
| TPP-Cl | 0.042 | 0.99 | 0.049 | 1.00 |

Thus, it can been observed that both of these phosphonium salts prevent speed loss upon incubation.

EXAMPLE 2

The experiment described in Example 1 was repeated with the tetraphenylphosphonium chloride in the range 50–150 mg/mole of silver and incubation time extended to 7 days.

TABLE 2

| INITIAL RESPONSE | | | | |
|---|---|---|---|---|
| TPP-Cl | Dmin | Speed (LogE) | Toe Contrast | Shoulder Contrast |
| None | 0.039 | 1.00 | 0.70 | 5.17 |
| 50 mg/mole | 0.043 | 1.03 | 0.73 | 5.33 |
| 100 mg/mole | 0.041 | 1.03 | 0.71 | 5.18 |
| 150 mg/mole | 0.039 | 1.00 | 0.73 | 5.26 |
| **INCUBATED RESPONSE** | | | | |
| TPP-Cl | ΔDmin | ΔSpeed (LogE) | ΔToe Contrast | ΔShoulder Contrast |
| None | | | | |
| Inc. 3 days | +0.010 | −0.13 | −0.10 | −0.20 |
| Inc. 7 days | +0.016 | −0.07 | −0.08 | −0.13 |
| 50 mg/mole | | | | |
| Inc. 3 days | +0.010 | −0.07 | −0.11 | +0.05 |
| Inc. 7 days | +0.015 | −0.04 | −0.13 | −0.15 |
| 100 mg/mole | | | | |
| Inc. 3 days | +0.008 | −0.08 | −0.08 | +0.08 |
| Inc. 7 days | +0.010 | −0.03 | −0.08 | 0 |
| 150 mg/mole | | | | |
| Inc. 3 days | +0.010 | −0.02 | −0.07 | +0.21 |
| Inc. 7 days | +0.014 | −0.01 | −0.07 | +0.06 |

For the particular emulsion under investigation, the optimum level of TTP-Cl was determined to be 150mg/mole of silver.

EXAMPLE 3

An emulsion hold time study was undertaken on the same sample described in Example 2, using 150mg TPP-Cl per mole of silver. Three equal portions of emulsion were held at 40° C. for up to 24 hours, to which TPP-Cl was (a) excluded, (b) added immediately prior to coating, and (c) added at the start of the hold time sequence. Table 3 lists the changes in speed and Dmin upon incubation for the hold time series. As in Example 2 above, there was little difference observed in contact values for all of these samples.

TABLE 3

| INITIAL RESPONSE | | | | | | |
|---|---|---|---|---|---|---|
| | Dmin | | | Speed (LogE) | | |
| Hold Time | | TPP-Cl at | | | TPP-Cl at | |
| (Hours) | Control | Coating | Start | Control | Coating | Start |
| 0 | 0.041 | 0.041 | 0.039 | 1.00 | 1.00 | 1.01 |
| 1 | 0.039 | 0.040 | 0.038 | 1.04 | 1.04 | 1.08 |
| 2 | 0.039 | 0.041 | 0.039 | 1.05 | 1.07 | 1.10 |
| 4 | 0.041 | 0.040 | 0.041 | 1.08 | 1.05 | 1.12 |
| 8 | 0.041 | 0.041 | 0.040 | 1.08 | 1.06 | 1.12 |
| 12 | 0.043 | 0.042 | 0..040 | 1.08 | 1.05 | 1.11 |
| 16 | 0.044 | 0.043 | 0.042 | 1.09 | 1.06 | 1.13 |
| 24 | 0.045 | 0.048 | 0.044 | 1.06 | 1.02 | 1.11 |
| INCUBATED RESPONSE - 3 DAYS | | | | | | |
| | ΔDmin | | | ΔSpeed (LogE) | | |

TABLE 3-continued

| Hold Time (Hours) | Control | TPP-Cl at Coating | TPP-Cl at Start | Control | TPP-Cl at Coating | TPP-Cl at Start |
|---|---|---|---|---|---|---|
| 0 | +0.010 | +0.010 | +0.011 | −0.12 | −0.04 | −0.05 |
| 1 | +0.010 | +0.009 | +0.013 | −0.17 | −0.06 | −0.09 |
| 2 | +0.010 | +0.009 | +0.013 | −0.18 | −0.08 | −0.07 |
| 4 | +0.010 | +0.008 | +0.011 | −0.23 | −0.09 | −0.07 |
| 8 | +0.008 | +0.006 | +0.012 | −0.26 | −0.11 | −0.14 |
| 12 | +0.007 | +0.008 | +0.012 | −0.25 | −0.11 | −0.12 |
| 16 | +0.007 | +0.008 | +0.012 | −0.28 | −0.14 | −0.16 |
| 24 | +0.007 | +0.007 | +0.011 | −0.27 | −0.15 | −0.17 |

INCUBATED RESPONSE - 7 DAYS

| Hold Time (Hours) | ΔDmin Control | ΔDmin TPP-Cl at Coating | ΔDmin TPP-Cl at Start | ΔSpeed (LogE) Control | ΔSpeed (LogE) TPP-Cl at Coating | ΔSpeed (LogE) TPP-Cl at Start |
|---|---|---|---|---|---|---|
| 0 | +0.012 | +0.014 | +0.016 | −0.10 | −0.08 | −0.07 |
| 1 | +0.011 | +0.011 | +0.017 | −0.15 | −0.09 | −0.09 |
| 2 | +0.010 | +0.011 | +0.017 | −0.17 | −0.12 | −0.09 |
| 4 | +0.013 | +0.011 | +0.017 | −0.18 | −0.09 | −0.07 |
| 8 | +0.011 | +0.008 | +0.018 | −0.18 | −0.14 | −0.13 |
| 12 | +0.010 | +0.012 | +0.017 | −0.24 | −0.15 | −0.12 |
| 16 | +0.010 | +0.012 | +0.016 | −0.25 | −0.18 | −0.17 |
| 24 | +0.010 | +0.012 | +0.016 | −0.27 | −0.20 | −0.15 |

While there is a small increase in incubated Dmin with increased hold time of TPP-Cl, this is more than offset by the advantages of:

1. A supersensitization effect.
2. Improved incubation stability.
3. Extended hold time of the liquid emulsion with respect to incubation stability.

EXAMPLE 4

The level of TTP-Cl was increased from 150 up to 300 mg/mole of silver and the experiment outlined in Example 3 was repeated at 0, 8 and 24 hours hold time. In this instance the quantity of phenylmercaptotetrazole was increased 15%. While the PMT reduced the initial speed, the TTP-Cl exhibited a greater supersensitization effect, plus the higher levels of TPP-Cl did not change the aging characteristics of the coatings.

TABLE 4

| | | INITIAL RESPONSE Dmin | Speed (LogE) |
|---|---|---|---|
| 150 mg/mole TTP-Cl | @ 0 hr. | 0.040 | 1.00 |
| | @ 8 hrs. | 0.041 | 1.16 |
| | @ 24 hrs. | 0.046 | 1.17 |
| 300 mg/mole TTP-Cl | @ 0 hr. | 0.039 | 1.04 |
| | @ 8 hrs. | 0.041 | 1.20 |
| | @ 24 hrs. | 0.042 | 1.20 |

| | | INCUBATED RESPONSE ΔDmin 3 days | ΔDmin 7 days | ΔSpeed (LogE) 3 days | ΔSpeed (LogE) 7 days |
|---|---|---|---|---|---|
| 150 mg/mole TTP-Cl | @ 0 hr. | +0.005 | +0.009 | +0.03 | +0.05 |
| | @ 8 hrs. | +0.007 | +0.010 | −0.12 | −0.12 |
| | @ 24 hrs. | +0.004 | +0.007 | −0.17 | −0.17 |
| 300 mg/mole TTP-Cl | @ 0 hr. | +0.008 | +0.009 | +0.03 | +0.05 |
| | @ 8 hrs. | +0.007 | +0.009 | −0.07 | −0.08 |
| | @ 24 hrs. | +0.008 | +0.009 | −0.15 | −0.17 |

Thus, the quantity of phosphonium salt required for optimum aging characteristics and supersensitization can be in the range 150–300mg/mole of silver, or possibly higher.

EXAMPLE 5

Using the same procedure stated in Example 1, equal portions of emulsion were sensitized to the infrared with the following dye sensitizers, and given a 1 hour hold time at 40° C. with and without 150mg TPP-Cl per mole of silver.

(a) 3,3'-diethyl-5'-methyl-6'-methoxy-9',11-neopentylene-thio-tri-carbocyanine iodide.

(b) 3-ethyl-2-(7-(3-ethyl-2-(3H)-benzoxazolidene)-4-chloro-3,5-dimethylene-1,3,5-heptatrienyl)benzoxazolium iodide.

(c) 3-ethyl-2-(5-(1-ethyl-2(1H)quinolinylidene)-1,3-pentadienyl)naptho(1,2-d)thiazolium iodide.

Examples 5(a) and 5(b) were exposed at 810 nm, while 5(c) was given a 770nm exposure. No significant difference in initial and incubated Dmin or contrast was observed between the TPP-Cl and control samples. Listed in Table 5 are the initial and incubated speeds.

TABLE 5

| Dye | Initial Speed (LogE) | 7 Day Incubated Speed (LogE) |
|---|---|---|
| (a) Control | 1.00 | −0.05 |
| (a) +TPP-Cl | 1.10 | −0.06 |
| (b) Control | 0.61 | +0.17 |
| (b) +TPP-Cl | 0.79 | +0.17 |
| (c) Control | 0.92 | +0.01 |
| (c) +TPP-Cl | 1.13 | −0.04 |

Although TPP-Cl did not improve the aging characteristics of these dye sensitizers, it did act as a supersensitizer.

EXAMPLE 6

The same technique outlined in Example 1 was used to study the effects of other analogues of the quaternary phosphonium salt of Formula (I):

6(a) 4-methylbenzyltriphenylphosphonium chloride.
6(b) Triphenylmethyltriphenylphosphonium bromide.
6(c) Tetraphenylphosphonium hexafluoroantimonate.
6(d) Tetraphenylphosphonium tetrafluoroborate.
6(e) Triphenylphosphonium bromide
6(f) Triphenylmethylphosphonium iodide.
6(g) Benzyltriphenylphosphonium chloride.

These analogues were incorporated into the emulsion at a level of 0.4 millimoles and 150 mg per mole of silver, and given a 2 hour hold time at 40° C. Table 6 lists the initial and 3 day incubated speeds.

TABLE 6

| Sample | Initial Speed (LogE) | 3 Day Incubated Speed (LogE) |
|---|---|---|
| Control | 1.00 | −0.10 |
| TPP-Cl @ 150 mg | 1.08 | −0.04 |
| 6(a) @ 0.4 mmole | 1.12 | −0.07 |
| 6(b) @ 150 mg | 1.09 | 0 |
| 6(c) @ 0.4 mmole | 1.08 | −0.07 |
| 6(d) @ 0.4 mmole | 1.08 | −0.06 |
| 6(e) @ 0.4 mmole | 1.36 | +0.05 |
| 6(f) @ 0.4 mmole | 0.98 | +0.02 |
| 6(g) @ 0.4 mmole | 1.08 | −0.04 |

Each of these analogues was found to supersensitize and/or improve the aging characteristics of the infrared sensitized emulsion.

EXAMPLE 7

The same technique outlined in Example 6 was used to study the effects of analogues of the quaternary ammonium salt of Formula (I):

7(a) Benzyldimethylphenylammonium chloride.
7(b) Benzyltriethylammonium chloride.
7(c) Dimethylbenzyltrimethylammonium iodide.
7(d) Tetrabutylammonium hydrogen sulfate.
7(e) Tetrabutylammonium tetrafluoroborate.
7(f) Tetraheptylammonium iodide.
7(g) Triethyl(m-hydroxyphenyl)ammonium iodide.

These analogues were incorporated into the emulsion at a level of 0.4 millimoles per mole of silver and given a 1 hour hold time at 40° C. Table 7 lists the initial and 7 day incubated Δ speeds.

TABLE 7

| Sample | Initial Speed (LogE) | 7 Day Incubated ΔSpeed (LogE) |
|---|---|---|
| Control | 1.00 | −0.09 |
| 7(a) | 1.01 | −0.02 |
| 7(b) | 0.98 | −0.02 |
| 7(c) | 0.96 | +0.02 |
| 7(d) | 0.98 | +0.04 |
| 7(e) | 0.98 | +0.03 |
| 7(f) | 1.12 | −0.07 |
| 7(g) | 1.00 | −0.03 |

With the exception of tetraheptylammonium iodide (THA-I), the above analogues reduced the speed change upon incubation. In this particular formulation THA-I, at a level of 0.4 millimole per mole of silver, supersensitizes but does not significantly affect incubation stability.

EXAMPLE 8

Using the same technique as outlined in Example 7, 0.4 millimoles per mole of silver of the following quaternary ammonium salts were studied for their effect on speed after a 2 hour hold time at 40° C.:

TABLE 8

| Sample | ΔSpeed (LogE) |
|---|---|
| Control | 1.00 |
| Tetramethylammonium iodide. | 0.99 |
| Tetraethylammonium iodide. | 1.00 |
| Tetrapropylammonium iodide. | 0.95 |
| Tetrabutylammonium iodide. | 0.95 |
| Tetrapentylammonium iodide. | 1.11 |
| Tetrahexylammonium iodide. | 1.17 |
| Tetraheptylammonium iodide. | 1.19 |
| Tetraoctylammonium iodide. | 1.18 |

Thus, the speed enhancing effect of the quaternary salts depends on the size of the functional group.

EXAMPLE 9

The following tetra-alkylammonium halides were studied in more detail in order to determine the effect of the organic and halide groups on both speed and stability. The same method as given in Example 8 was used.

9(a). Tetramethylammonium bromide.
9(b). Tetraethylammonium bromide.
9(c). Tetraethylammonium chloride.
9(d). Tetrabutylammonium bromide.
9(e). Tetrabutylammonium iodide.
9(f). Tetraheptylammonium bromide.
9(g). Tetraheptylammonium iodide.
9(h). Ammonium bromide.

TABLE 9

| Sample | Initial Speed (LogE) | 7 Day Incubated Speed (LogE) |
|---|---|---|
| Control | 1.00 | −0.20 |
| 9(a) | 0.99 | −0.20 |
| 9(b) | 0.98 | −0.19 |
| 9(c) | 0.98 | −0.20 |
| 9(d) | 0.96 | −0.05 |
| 9(e) | 0.94 | −0.01 |
| 9(f) | 1.13 | −0.18 |
| 9(g) | 1.14 | −0.16 |
| 9(h) | 1.02 | −0.20 |

It is again demonstrated that the organic functional group, and not the halide anion, which imparts additional speed. Likewise, the effect on stability is due to the nature of the alkyl group rather than the halide. Also, it has been shown that ammonium bromide has no beneficial effect on the infrared sensitized emulsion. This data therefore refutes the claims of Mihara in U.S. Pat. No. 4,536,472 in which he describes the use of water soluble bromides, e.g., ammonium and tetraethylammonium bromides, to improve speed and shelf-life.

EXAMPLE 10

The $C_4$–$C_8$ tetra-alkylammonium iodides were studied for stability, according to the method in Example 8. Hold time was increased to 3 hours at 40° C.

10(a). Tetrabutylammonium iodide.
10(b). Tetrapentylammonium iodide.
10(c). Tetrahexylammonium iodide.
10(d). Tetraheptylammonium iodide.
10(e). Tetraoctylammonium iodide.

TABLE 10

| Sample | Initial Speed (LogE) | 7 Day Incubated Speed (LogE) |
|---|---|---|
| Control | 1.00 | −0.26 |
| 10(a) | 0.97 | −0.13 |
| 10(b) | 1.12 | −0.24 |
| 10(c) | 1.16 | −0.26 |
| 10(d) | 1.19 | −0.20 |
| 10(e) | 1.17 | −0.19 |

Therefore, the degree of supersensitization and/or stabilization depends upon both the hold time and the organic functional groups.

EXAMPLE 11

A low contrast, undoped, 3:97 iodobromide emulsion, with an average grain size of 0.24 micron, was spectrally sensitized at pH 7.0 and pAg 7.2, using the dye described in Example 1. Equal portions of the emulsion were given two hour hold times at 40° C., with and without mg of TPP-Cl per mole of silver, coated and then incubated for 7 days at 60% RH/50° C. Table 11 demonstrates that TPP-Cl also works as a stabilizer in iodobromide emulsions.

TABLE 11

| Sample | Initial Speed (LogE) | 7 Day Incubated Speed (LogE) |
|---|---|---|
| Control | 1.00 | −0.39 |
| +TPP-Cl | 1.00 | −0.30 |

EXAMPLE 12

A low contrast, undoped, 64:36 chlorobromide emulsion, of average particle size 0.24 micron diameter, adjusted to pH 7.0 and pAg 7.2, was sensitized to the infrared using the dye in Example 5(a). In addition, 115 mg of phenylmercaptotetrazole per mole of silver was added in the form of a methanol solution. Aqueous solutions of TTP-Cl, TPP-Br, and triphenylmethyltriphenylphosphonium bromide (TPMTPP-Br) were added and held for 2 hours prior to coating. The initial and incubated speeds are listed in Table 12.

TABLE 12

| Sample | Initial Speed (LogE) | 7 Day Incubated Speed (LogE) |
|---|---|---|
| Control | 1.00 | −0.22 |
| 100 mg/mole TPP-Br | 0.94 | −0.16 |
| 100 mg/mole TPP-Cl | 0.90 | −0.11 |
| 100 mg/mole TPMTPP-Br | 1.00 | −0.12 |
| 400 mg/mole TPMTPP-Br | 1.01 | −0.09 |

Thus, while in this particular formulation the phosphonium salts desensensitize the emulsion, there is a significant improvement in accelerated aging.

EXAMPLE 13

Using the same emulsion given in Example 12, the level of phosphonium salts was increased and 15 g of a poly(ethylacrylate) (PEA) suspension was also incorporated into the formulation.

TABLE 13

| Sample | Initial Speed (LogE) | 7 Day Incubated ΔSpeed (LogE) |
|---|---|---|
| Control | 1.00 | −0.20 |
| 100 mg/mole TPP-Br | 0.96 | −0.18 |
| 200 mg/mole TPP-Br | 0.93 | −0.15 |

TABLE 13-continued

| Sample | Initial Speed (LogE) | 7 Day Incubated ΔSpeed (LogE) |
|---|---|---|
| 100 mg/mole TPP-Cl | 0.93 | −0.14 |
| 200 mg/mole TPP-Cl | 0.90 | −0.15 |
| 300 mg/mole TPP-Cl | 0.90 | −0.13 |

Beyond a certain limit, the stabilizing effect of the phosphonium salts reach optimum. Therefore, not only do these components offer a solution to aging stability, they also exhibit broad process latitude.

EXAMPLE 14

The following analogs were evaluated at a level of 400 mg. per mole of silver, using the emulsion and conditions outlined in Example 13.

14(a). Tetraethylphosphonium iodide.
14(b) Tetramethylammonium fluoride.
14(c). Tetramethylammonium iodide.
14(d). Tetraethylammonium iodide.
14(e). Tetrahydroxyethylammonium bromide.
14(f). Trimethylphenylammonium chloride.
14(g). Trimethylphenylammonium iodide.
14(h). Triethylphenylammonium iodide.
14(i). Tetrapentylammonium chloride.
14(j). Tetrapentylammonium bromide.
14(k). Tetrapentylammonium iodide.
14(l). Tetrahexylammonium bromide.
14(m). Tetrahexylammonium iodide.
14(n). Tetraheptylammonium chloride.
14(o). Tettraheptylammonium bromide.
14(p). Tetraheptylammonium iodide.
14(q). Tetraoctylammonium bromide.
14(r). Tetraoctylammonium iodide

TABLE 14

| Sample | Initial Speed (LogE) | 7 Day Incubated ΔSpeed (LogE) |
|---|---|---|
| Control | 1.00 | −0.21 |
| 14(a) | 0.96 | −0.18 |
| 14(b) | 1.01 | −0.24 |
| 14(c) | 0.97 | −0.23 |
| 14(d) | 0.95 | −0.23 |
| 14(e) | 1.02 | −0.16 |
| 14(f) | 0.95 | −0.23 |
| 14(g) | 0.94 | −0.23 |
| 149H0 | 0.93 | −0.24 |
| 14(i) | 1.01 | −0.18 |
| 14(j) | 1.03 | −0.17 |
| 14(k) | 1.03 | −0.18 |
| 14(l) | 1.09 | −0.12 |
| 14(m) | 1.07 | −0.16 |
| 14(n) | 1.11 | −0.11 |
| 14(o) | 1.13 | −0.09 |
| 14(p) | 1.10 | −0.12 |
| 14(q) | 1.13 | −0.10 |
| 14(r) | 1.08 | −0.11 |

Again, it has been shown that it is the nature of the quaternary groups, and not the bromide anion, that is responsible for the improved speed and stability. These examples also show maximum sensitivity and stability with long chain alkyl ammonium salts, in particular tetrahexyl, tetraheptyl and tetraoctyl ammonium halides. Compared to Example 7(g), THA-I also demonstrates a stabilization effect at a level of 400mg (equivalent to 0.75 millimoles) per mole of silver. Therefore, the ability of compounds of Formula (I) to demonstrate both a supersensitization and a stabilization effect, depends on the type of emulsion and the level of quaternary salt used.

EXAMPLE 15

TPP-Cl was incorporated into the protective top layer of a coating according to Example 1, at a level of 80 mg per mole of silver. Initial and 7 day incubated speeds are listed in Table 15.

TABLE 15

| Sample | Initial Speed (LogE) | 7 Day Incubated ΔSpeed (LogE) |
|---|---|---|
| Control | 1.00 | −0.09 |
| TPP-Cl | 0.90 | −0.04 |

Thus, even when incorporated into an adjacent layer, the compounds of the invention, such as tetraphenylphosphonium chloride demonstrate a stabilization effect. This is apparently due to a migration of the compounds into the emulsion layer.

We claim:

1. A silver halide photographic emulsion containing at least one spectral sensitizing dye which provides sensitivity to said emulsion in the infrared region of the electromagnetic spectrum, said emulsion or top coat being characterized by containing a salt of the formula:

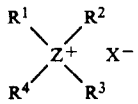

where $R^1$, $R^2$, $R^3$, and $R^4$ are independently selected from the group consisting of alkyl, aryl, aralkyl and alkaryl, or where two adjacent groups of $R^1$, $R^2$, $R^3$ and $R^4$ may form a 5-, 6-, or 7- membered heterocyclic ring with the included Z atom, and wherein the total number of carbon atoms in $R^1$, $R^2$, $R^3$, and $R^4$ is at least 18, with two of said $R^1$, $R^2$, $R^3$, and $R^4$ having at least 5 carbon atoms, Z is P or N, and $X^-$ is an acid anion.

2. The emulsion of claim 1 wherein said salt is present in an amount of at least 0.05 millimoles per mole of silver in said emulsion.

3. The emulsion of claim 1 wherein said salt is present in an amount of between 0.1 and 0.8 millimoles per mole of silver in said emulsion and Z is nitrogen.

4. The emulsion of claim 1 wherein $R^1$, $R^2$, $R^3$, and $R^4$ are independently aryl groups.

5. The emulsion of claim I wherein $R^1$, $R^2$, $R^3$, and $R^4$ are independently alkyl groups of at least 5 carbon atoms.

6. The emulsion of claim 1 wherein $R^1$, $R^2$, $R^3$, and $R^4$ are independently alkaryl groups.

7. The emulsion of claim 2 wherein $R^1$, $R^2$, $R^3$, and $R^4$ are independently alkyl groups of at least 6 carbon atoms.

8. The emulsion of claim 1 wherein $R^1$, $R^2$, $R^3$, and $R^4$ have a total of between 20 and 56 carbon atoms and Z is phosphorus.

9. The emulsion of claim 2 wherein $R^1$, $R^2$, $R^3$, and $R^4$ have a total of between 20 and 56 carbon atoms and Z is phosphorus.

10. The emulsion of claim 4 wherein $R^1$, $R^2$, $R^3$, and $R^4$ have a total of between 20 and 56 carbon atoms and wherein Z is nitrogen.

11. The emulsion of claim 5 wherein $R^1$, $R^2$, $R^3$, and $R^4$ have a total of between 20 and 56 carbon atoms.

12. The emulsion of claim 6 wherein $R^1$, $R^2$, $R^3$, and $R^4$ have a total of between 20 and 56 carbon atoms and wherein Z is nitrogen.

13. The emulsion of claim 8 wherein said silver halide contains dopant levels of Group VIII metals.

14. The emulsion of claim 9 wherein said silver halide contains dopant levels of Group VIII metals.

15. The emulsion of claim 10 wherein said silver halide contains dopant levels of Group VIII metals and wherein Z is nitrogen.

16. The emulsion of claim 11 wherein said silver halide contains dopant levels of Group VIII metals and Z is phosphorus.

17. The emulsion of claim 1 wherein Z is nitrogen and $X^-$ is selected from iodide, bromide, chloride, tetrafluoroborate, hexafluoroantimonate, p-toluenesulfonic acid, and hydrogen sulfate.

18. The emulsion of claim 7 wherein Z is nitrogen and $R^1$, $R^2$, $R^3$, and $R^4$ are selected from hexyl, heptyl and octyl.

19. The emulsion of claim 1 wherein said silver halide is selected from the group consisting of silver iodobromide, silver chloroiodide, and silver chlorobromoiodide.

20. The emulsion of claim 10 wherein said silver halide is selected from the group consisting of silver iodobromide, silver chloroiodide, and silver chlorobromoiodide.

21. A silver halide photographic emulsion containing at least one spectral sensitizing dye which provides sensitivity to said emulsion in the infrared region of the electromagnetic spectrum, said emulsion or top coat being characterized by containing a salt of the formula:

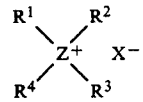

where $R^1$, $R^2$, $R^3$, and $R^4$ are independently selected from alkyl groups, or where two adjacent groups of $R^1$, $R^2$, $R^3$, and $R^4$ may form a 5-, 6-, or 7-membered heterocyclic ring with the included Z atom, and wherein the total number of carbon atoms in $R^1$, $R^2$, $R^3$, and $R^4$ is at least 18, with two of said $R^1$, $R^2$, $R^3$, and $R^4$ having at least 5 carbon atoms, Z is p or N, and $X^-$ is an acid anion.

22. The emulsion of claim 21 wherein said salt is present in an amount of at least 0.05 millimoles per mole of silver in said emulsion.

23. The emulsion of claim 21 wherein said salt is present in an amount of between 0.1 and 0.8 millimoles per mole of silver in said emulsion and Z is nitrogen.

24. The emulsion of claim 21 wherein $R^1$, $R^2$, $R^3$, and $R^4$ are independently alkyl groups of at least 5 carbon atoms.

25. The emulsion of claim 22 wherein $R^1$, $R^2$, $R^3$, and $R^4$ are independently alkyl groups of at least 6 carbon atoms.

26. The emulsion of claim 21 wherein $R^1$, $R^2$, $R^3$, and $R^4$ have a total of between 20 and 56 carbon atoms and Z is phosphorus.

27. The emulsion of claim 22 wherein $R^1$, $R^2$, $R^3$, and $R^4$ have a total of between 20 and 56 carbon atoms and Z is phosphorus.

28. The emulsion of claim 23 wherein $R^1$, $R^2$, $R^3$, and $R^4$ have a total of between 20 and 56 carbon atoms and wherein Z is nitrogen.

29. The emulsion of claim 26 wherein said silver halide contains dopant levels of Group VIII metals.

30. The emulsion of claim 28 wherein said silver halide contains dopant levels of Group VIII metals.

31. The emulsion of claim 21 wherein said silver halide contains dopant levels of group VIII metals and wherein Z is nitrogen.

32. The emulsion of claim 21 wherein said silver halide contains dopant levels of Group VIII metals and Z is phosphorus.

33. The emulsion of claim 22 wherein Z is nitrogen and $X^-$ is selected from iodide, bromide, chloride, tetrafluoroborate, hexafluoroantimonate, p-toluenesulfonic acid, and hydrogen sulfate.

34. The emulsion of claim 25 wherein Z is nitrogen and $R^1$, $R^2$, $R^3$, and $R^4$ are selected from hexyl, heptyl and octyl.

35. A silver halide photographic emulsion containing at least one spectral sensitizing dye which provides sensitivity to said emulsion in the infrared region of the electromagnetic spectrum, said emulsion or top coat being characterized by containing a salt of the formula:

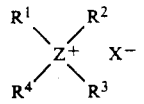

where $R^1$, $R^2$, $R^3$, and $R^4$ are independently selected from the group consisting of alkyl, aryl, aralkyl and alkaryl; or where two adjacent groups of $R^1$, $R^2$, $R^3$, and $R^4$ may form a 5-, 6-, or 7- membered heterocyclic ring with the included Z atom, and wherein the total number of carbon atoms in $R^1$, $R^2$, $R^3$, and $R^4$ is at least 18, with two of said $R^1$, $R^2$, $R^3$, and $R^4$ having at least 5 carbon atoms, Z is P or N, and $X^-$ is an acid anion other than $Br^-$.

36. The emulsion of claim 1 wherein $X^-$ is selected from the iodide, chloride, tetrafluoroborate, hexafluoroantimonate, p-toluenesulfonic acid, and hydrogen sulfate.

37. A silver halide photographic emulsion containing at least one spectral sensitizing dye which provides sensitivity to said emulsion in the infrared region of the electromagnetic spectrum, said emulsion or a top coat on said emulsion being characterized by containing a tetrabutylammonium or tetrabutylphosphonium salt with an acid anion.

* * * * *